US005269904A

United States Patent [19]

Fong et al.

[11] Patent Number: 5,269,904

[45] Date of Patent: Dec. 14, 1993

[54] SINGLE TANK DE-OXIDATION AND ANODIZATION PROCESS

[75] Inventors: Calvin C. Fong, Beverly Hills; Rimas Viktora, Redondo Beach, both of Calif.

[73] Assignee: Northrop Corporation, Los Angeles, Calif.

[21] Appl. No.: 895,317

[22] Filed: Jun. 5, 1992

[51] Int. Cl.[5] ..... C25D 5/44; C25D 11/04

[52] U.S. Cl. ..... 205/87; 205/106; 205/213; 205/215; 205/216; 205/219

[58] Field of Search ..... 205/106, 107, 108, 175, 205/213, 219, 87, 215, 216

[56] References Cited

U.S. PATENT DOCUMENTS

| | | | |
|---|---|---|---|
| 2,682,503 | 6/1954 | Hesch | 204/33 |
| 2,708,655 | 5/1955 | Turner | 204/140.5 |
| 3,063,917 | 11/1962 | Barto | 204/32 |
| 3,834,998 | 9/1974 | Watanabe et al. | 204/33 |
| 4,085,012 | 4/1978 | Marceau et al. | 204/38 A |
| 4,127,451 | 11/1978 | Marceau et al. | 204/38 A |
| 4,263,113 | 4/1981 | Bernard | 204/146 |
| 4,397,716 | 8/1983 | Gilliland et al. | 204/33 |
| 4,623,591 | 11/1986 | Pike | 428/414 |
| 4,624,752 | 11/1986 | Arrowsmith et al. | 204/37.6 |
| 4,647,346 | 3/1987 | Miller et al. | 204/29 |
| 4,793,903 | 12/1988 | Holmquist et al. | 204/33 |
| 4,853,093 | 8/1989 | Brenk et al. | 204/37.6 |

*Primary Examiner*—John Niebling
*Assistant Examiner*—William T. Leader
*Attorney, Agent, or Firm*—Terry J. Anderson; Robert B. Block; Karl J. Hoch, Jr.

[57] ABSTRACT

The invention is a single-bath electrolytic de-oxidation and anodization process in which a workpiece surface such as an aluminum surface is electrolytically de-oxidized and then anodized to form an adhesive oxide layer in the same electrolytic chemical bath without removing the workpiece from the bath. Upon completion of the anodization step, the piece is rinsed in a water bath. The invention further includes recirculating the electrolytic bath through a filter to suppress contaminant levels in the bath to prevent metal ion or organic contaminants from the de-oxidation step from compromising the integrity of the anodization step.

11 Claims, No Drawings

SINGLE TANK DE-OXIDATION AND ANODIZATION PROCESS

BACKGROUND OF THE INVENTION

1. Technical Field

The invention relates to processes for de-oxidizing or cleaning surfaces such as aluminum and then forming an adhesive oxide layer thereon suitable for bonding thereto.

2. Background Art

Many techniques are known in the art for treating aluminum surfaces, as disclosed in U.S. Pat. Nos. 3,834,998; 4,085,012; 4,127,451; 4,397,716; 4,623,591; 4,624,752; 4,647,346; 4,793,903 and 4,853,093. Such techniques are generally characterized by separate chemical baths for performing de-oxidation or for performing anodization. For example, U.S. Pat. No. 4,793,903 discloses an electrolytic process for de-oxidizing aluminum surfaces in a first chemical bath containing a phosphoric acid solution which is followed by a rinse step prior to a subsequent anodization step. The subsequent anodization step deposits a strongly adherent aluminum oxide layer suitable for bonding, and is carried out in a second chemical bath containing a phosphoric acid solution as disclosed in U.S. Pat. Nos. 4,085,012 and 4,127,451. The second chemical bath is free of the contaminants removed in the de-oxidizing bath. The intervening rinse step prevents any transfer of such contaminants between the two baths via the workpiece.

All of the foregoing is distinguished from electrolytic polishing techniques of the type disclosed in U.S. Pat. No. 2,708,655, in which an aluminum workpiece is polished by first de-oxidizing it in a chemical bath containing phosphoric and sulfuric acids and ethylene glycol mono ethyl ether, after which it is electrolytically polished in the same bath and rinsed in a wetting solution. This process deposits a thin non-adherent aluminum oxide layer, which is removed by immersion in another chemical bath which does not attack the now-polished surface prior to any anodizing steps. Anodization may occur in yet another chemical bath comprising either a chromic or sulfuric acid solution.

A major disadvantage of the phosphoric acid electrolytic de-oxidizing and anodization process of U.S. Pat. Nos. 4,793,903, 4,085,012 and 4,127,451 is its high capital cost. Specifically, as many as four chemical baths are required: the phosphoric acid solution for de-oxidizing, the intervening rinse bath, the phosphoric acid solution for anodizing and a final rinse bath. Consider for example a process in which each bath contains 13,000 gallons in a stainless steel container. The two rinse tanks would have to be disposed of periodically as they accumulate acid rinsed off many successive work pieces. Disposal of two 13,000 gallon chemical rinse tanks from the Los Angeles, California metropolitan area costs approximately $39,000. Moreover, each of the two acid baths requires a 13,000 gallon stainless steel container and related equipment including a rectifier for the electrolytic source, a temperature control unit, and agitation systems.

Unfortunately, it has seemed that, in view of the requirement to keep the anodization bath free of the contaminants created during the de-oxidation step, no reduction in the number of chemical baths is possible for practical application.

Accordingly, it is an object of the present invention to provide a process for electrolytically de-oxidizing and anodizing a surface such as an aluminum surface using a smaller number of chemical baths, without compromising the integrity of the anodization step through the introduction of contaminants from the de-oxidation step.

SUMMARY OF THE INVENTION

The invention is a single-bath electrolytic de-oxidation and anodization process in which a workpiece surface such as an aluminum surface is electrolytically de-oxidized and then anodized to form an adhesive oxide layer in the same electrolytic chemical bath without removing the workpiece from the bath. Upon completion of the anodization step, the piece is rinsed in a water bath. The process of the invention accomplishes the foregoing without the contaminants from the de-oxidation step compromising the integrity of the anodization step.

The commercially useful embodiment of the invention further includes recirculating the electrolytic bath through a filter to suppress contaminant levels in the bath. This latter feature prevents contaminants from the de-oxidation step from compromising the integrity of the anodization step.

The electrolytic bath preferably is a phosphoric acid solution and the de-oxidation step includes anodizing the work piece at a rate slower than the oxide removal or etch rate of the solution, while the anodization step is carried out without removing the work piece from the bath by increasing the anodization voltage so that the anodization rate exceeds the etch rate.

The invention reduces the capital cost of a de-oxidation and anodization process significantly because the invention requires only one acid bath (not two, as in the prior art) and only one rinse bath (not two, as in the prior art). It is estimated that the initial capital cost-savings in an electrolytic de-oxidation and anodization process employing 13,000 gallon tanks would be on the order of one million dollars.

DETAILED DESCRIPTION OF THE INVENTION

The preferred embodiment of the invention will now be described with reference to a working example. An aluminum workpiece to be anodized is first cleaned in Isoprop 44, a cleaning solution sold by Allied-Kelite, and then rinsed in water. It is next immersed in an electrolytic bath consisting of between 10% and 12% by weight of phosphoric acid in a water solution held at a temperature of between 90 and 100 degrees Fahrenheit. While in the electrolytic bath, a de-oxidation step and an anodization step are performed.

First, the de-oxidation step is carried out by applying a positive electrical potential of between 4 and 6 volts D.C. to the workpiece with respect to a lead cathode in the electrolytic solution for a first period of time between 14 and 16 minutes. This causes new oxide material to be formed on the workpiece surface at one rate while the electrolytic solution continually removes oxide material at a second (higher) rate determined principally by the temperature of the electrolytic solution. The new oxide material assists in the removal of the old oxide material and may be thought of as undercutting the old oxide material.

Next, after all of the oxide material has been removed, the anodization step is carried out by increasing the positive electrical potential of the workpiece to between 14 and 16 volts D.C. with respect to the cathode for between 23 and 25 minutes. (Alternatively, if the 4 to 6 volt potential of the oxidation process is simply removed upon completion thereof, then the 14 to 16 potential of the anodization process must be applied within 30 seconds after removal of the previous potential.) At the end of this time, the workpiece is removed from the electrolytic solution or bath, rinsed in deionized water and dried at a temperature of between 125 and 150 degrees Fahrenheit.

Metallic ions (such as aluminum or copper) may be redeposited on the workpiece during the anodization process, thus deleteriously altering the aluminum surface thereof. With usage, the electrolytic solution will build up metal ion contamination. In commercial applications of the invention where a large constant throughput must be maintained, the invention includes a step which keeps the electrolytic solution relatively free of contaminants (i.e., metallic ions) produced by the de-oxidation steps. This step consists of recirculating the electrolytic solution through a filtration system designed to remove contaminants such as aluminum and copper ions. One example of such a filtration system is the Acid Purification Unit sold by Eco-Tec, Inc. in Ontario, Canada.

Organic contaminants in the electrolytic solution are removed by recirculation of the solution through a standard activated carbon filtration unit. The recirculation through the APU and through the activated carbon filtration unit is carried on continuously in the preferred embodiment of the invention.

The single tank electrolytic de-oxidation and anodization process of the invention is also useful for anodizing workpieces comprising the following metals: lead, zinc, brass, copper, nickel and magnesium. As applied to aluminum, the preferred embodiment described above forms an adhesive aluminum oxide layer of between 5,000 and 10,000 Angstroms thickness on the aluminum surface.

While the invention has been described in detail by specific reference to preferred embodiments thereof, it is understood that variations and modifications may be made without departing from the true spirit and scope of the invention.

What is claimed is:

1. A method of de-oxidizing and anodizing in a single electrolytic bath a workpiece comprising a metal selected from the group of metals consisting of aluminum, lead, zinc, brass, copper, nickel and magnesium, so as to form an adhesive metal oxide layer on said workpiece, said method comprising:

immersing said workpiece in an electrolytic bath which etches metal oxide from said workpiece at a predetermined etch rate;

applying a first positive electrical potential to said workpiece relative to a cathode in contact with said bath, said first positive electrical potential causing formation of metal oxide on said workpiece at a first anodization rate less than said etch rate whereby a net reduction of metal oxide on said workpiece occurs during the applying of said first potential;

while retaining said workpiece in said electrolytic bath, applying a second positive electrical potential greater than said first potential to said workpiece relative to said cathode, said second positive electrical potential causing formation of metal oxide on said workpiece at a second anodization rate greater than said etch rate whereby a net increase of metal oxide on said workpiece occurs during the applying of said second potential, whereby to form an adhesive layer of metal oxide on said workpiece.

2. The method of claim 1 further comprising continually removing contamination from said electrolytic bath.

3. The method of claim 2 wherein said removing comprises recirculating said electrolytic bath through a filter system.

4. The method of claim 3 wherein said filter system comprises filters for removing metal ions and organic contamination.

5. The method of claim 1 wherein said electrolytic bath comprises a water solution of phosphoric acid.

6. The method of claim 5 wherein said first applying step comprises applying a voltage of between +4 and +6 volts to said workpiece for between 14 and 16 minutes.

7. The method of claim 6 wherein said second applying step comprises applying a voltage of between +14 and +16 for 23 to 25 minutes.

8. The method of claim 7 further comprising maintaining said electrolytic bath at a temperature between 90 and 100 degrees Fahrenheit.

9. The method of claim 5 wherein said workpiece 0 comprises aluminum and said electrolytic bath comprises between 10% and 12% by weight said phosphoric acid.

10. The method of claim 1 wherein said second applying step commences after said first applying step has removed substantially all metal oxide from said workpiece.

11. The method of claim 1 further comprising removing said workpiece from said bath after completion of said second applying, and rinsing said workpiece.

* * * * *